US009593498B2

(12) United States Patent
Wyrick

(10) Patent No.: US 9,593,498 B2
(45) Date of Patent: Mar. 14, 2017

(54) SYSTEM FOR AUTOMATICALLY OPENING AND CLOSING A TWO-PART HINGED COVER FOR A SWIM SPA

(71) Applicant: Justin Wyrick, West York, IL (US)

(72) Inventor: Justin Wyrick, West York, IL (US)

( * ) Notice: Subject to any disclaimer, the term of this patent is extended or adjusted under 35 U.S.C. 154(b) by 726 days.

(21) Appl. No.: 13/852,329

(22) Filed: Mar. 28, 2013

(65) Prior Publication Data

US 2014/0289954 A1 Oct. 2, 2014

(51) Int. Cl.
*E04H 4/00* (2006.01)
*E04H 4/08* (2006.01)

(52) U.S. Cl.
CPC ..... *E04H 4/084* (2013.01)

(58) Field of Classification Search
CPC ..... E04H 4/084; E04H 4/108
USPC ..... 4/498; 220/817
See application file for complete search history.

(56) References Cited

U.S. PATENT DOCUMENTS 5,065,884 A * 11/1991 Naritomi ..... B65D 43/26 220/264
6,032,305 A * 3/2000 Tedrick ..... E04H 4/084 220/817
6,795,984 B1 * 9/2004 Brady ..... E04H 4/084 220/263
6,802,086 B1 10/2004 Hudzinski
7,155,756 B1 1/2007 Helder
7,281,280 B2 * 10/2007 Lahay ..... E04H 4/084 4/498
7,290,297 B2 11/2007 Cunerty
7,500,276 B2 * 3/2009 Koren ..... E04H 4/084 4/498
7,752,685 B2 7/2010 Tudor
7,971,287 B2 7/2011 Buzzetti et al.
2007/0079434 A1 4/2007 Pellerin
2008/0184476 A1 8/2008 Albert et al.
2010/0313352 A1 12/2010 Sloss

* cited by examiner

*Primary Examiner* — Lauren Crane
(74) *Attorney, Agent, or Firm* — Woodard, Emhardt, Moriarty, McNett & Henry LLP

(57) ABSTRACT

A system is provided for automatically opening and closing a two-part longitudinally hinged longitudinal cover for a swim spa. The automatic swim spa cover opening and closing system is characterized by a longitudinal support that spans between and along longitudinal ends of the two cover parts, first and second drive mechanisms disposed on opposite longitudinal ends of the swim spa, a first drive arm operatively connected to and between the first drive mechanism and a first end of the longitudinal support, and a second drive arm operatively connected to and between the second drive mechanism and a second end of the longitudinal support. The drive mechanisms each include a hydraulic cylinder operating configured drive gearing that operates configured drive arm gearing. The drive and arm gearing provide a two-stage operation of the drive arm to separately pivot the two cover parts for opening and closing the two-part swim spa cover.

17 Claims, 10 Drawing Sheets

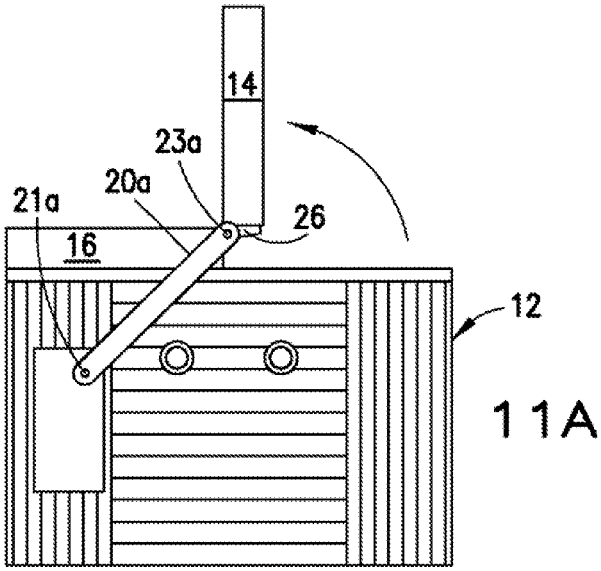
11A
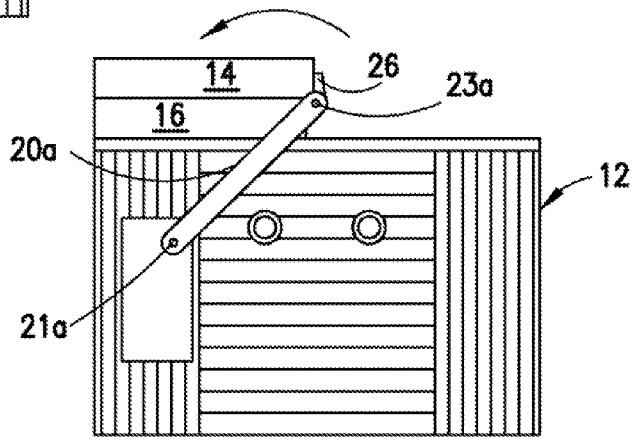
11B
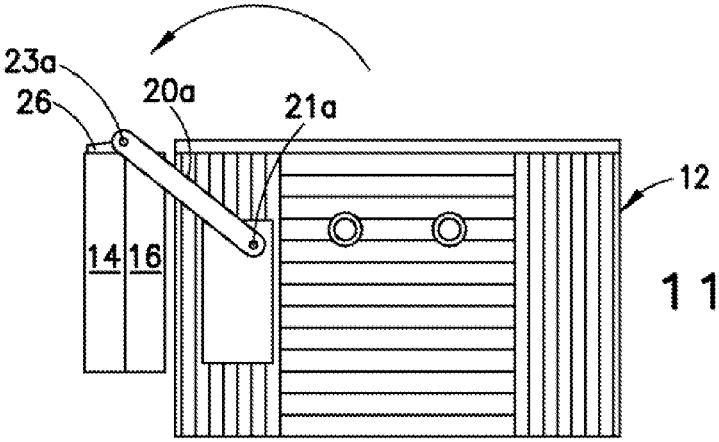
11C

SYSTEM FOR AUTOMATICALLY OPENING AND CLOSING A TWO-PART HINGED COVER FOR A SWIM SPA

FIELD OF THE INVENTION

The present invention relates to the field of swim spas and, more particularly, to automated systems for opening and closing a cover for a swim spa.

BACKGROUND

A swim spa, otherwise known as a fitness spa or exercise spa, is different that typical or regular spas or hot tubs by having features that allow a user to swim continuously against a current of water within the confines of the swim spa. The swim spa is thus designed to generate a continuous and controllable current of water against which the user can then swim in place—in contrast to a hot tub or spa in which a user just sits in the water.

Because a swim spa allows a user to swim within its confines, it must be at least a certain length in order to allow the user to stretch out and swim. Because of this, swim spas generally have a length of between twelve feet (12') and twenty four feet (24') and are typically in the general shape of an elongated rectangle. Hot tubs on the other hand, while generally rectangular, have a typical length of between six feet (6') and ten feet (10'). Swim spas and hot tubs are both similar in width, ranging from about six feet (6') to about eight feet (8'). Therefore, while the width of both hot tubs and swim spas are typically the same, a swim spa is much longer in length.

It is desirable, if not necessary, that swim spas and hot tubs be covered when not in use. Not only does this prevent heat dissipation from the water, it also prevents dirt, debris and other non-desirable materials from entering and contaminating the water. Hot tub covers are essentially two padded mats that are hinged to one another so as to lie on top of the hot tub and over the water. In order to uncover the hot tub, the mats must be folded and removed from the opening. Because these covers are fairly large and bulky, systems have been developed that automatically open and close two-part hinged hot tub covers. However, because a swim spa is much longer than a hot tub as pointed out above, two-part hinged padded mats for swim spas are along the longitudinal and thus much longer and much heavier and bulkier to move than two-part hinged hot tub covers. The extended or longitudinal length of a swim spa thus poses particular problems in using prior art automatic opening and closing systems for two-part hinged hot tub covers with the longitudinal two-part swim spa covers. As such, prior art automatic opening and closing systems for two-part hinged hot tub covers will not work for longitudinal two-part hinged swim spa covers.

It is apparent from the above that there exists a need for an automatic opening and closing system for a longitudinal two-part hinged swim spa cover.

SUMMARY OF THE INVENTION

A system, method, assembly, and mechanism is provided for automatically opening and closing a two-part hinged cover for a swim spa wherein the two cover parts span and are hinged together along the longitudinal length of the swim spa.

The automatic swim spa cover opening and closing system is characterized by a longitudinal support spanning between and along the longitudinal ends of the two hinged cover parts, first and second drive mechanisms disposed on opposite longitudinal ends of the swim spa, a first drive arm assembly operatively connected to and between the first drive mechanism and a first end of the longitudinal support, and a second drive arm assembly operatively connected to and between the second drive mechanism and a second end of the longitudinal support. The longitudinal support is pivotally controlled by the first and second drive arm assemblies. Pivoting of the longitudinal support provides pivoting of the cover parts.

When driven by the drive mechanisms, the respective drive gearings and arm gearings together provide a two-stage opening or uncovering operation of the respective drive arm assembly to separately pivot one cover part to uncover half of the swim spa, then pivot both cover parts together to uncover the remaining half of the swim spa and stow the two cover parts. The drive gearings and arm gearings also together provide a two-stage closing or covering operation of the respective drive arm assembly to pivot both stowed cover parts onto and cover a first half of the swim spa with one cover part, then pivot only the other cover part onto and cover the other half of the swim spa to entirely close or cover the swim spa.

The present automatic swim spa cover opening and closing system preferably, but not necessarily, utilizes hydraulics to actuate the drive gearing.

The present invention provides various advantages over prior art automatic swim spa cover opening and closing systems.

BRIEF DESCRIPTION OF THE DRAWINGS

The above mentioned and other features, advantages and object of this invention, and the manner of attaining them, will become apparent and the invention itself will be better understood by reference to the following description of an embodiment of the invention taken in conjunction with the accompanying drawings, wherein:

FIGS. 11A-C depict side views of the opening of the longitudinal two-part hinged cover from the swim spa.

Like reference numerals indicate the same or similar parts throughout the several figures.

A description of the features, functions and/or configuration of the components depicted in the various figures will now be presented. It should be appreciated that not all of the features of the components of the figures are necessarily described. Some of these non discussed features as well as discussed features are inherent from the figures. Other non discussed features may be inherent in component geometry and/or configuration.

DETAILED DESCRIPTION

Figure 1:
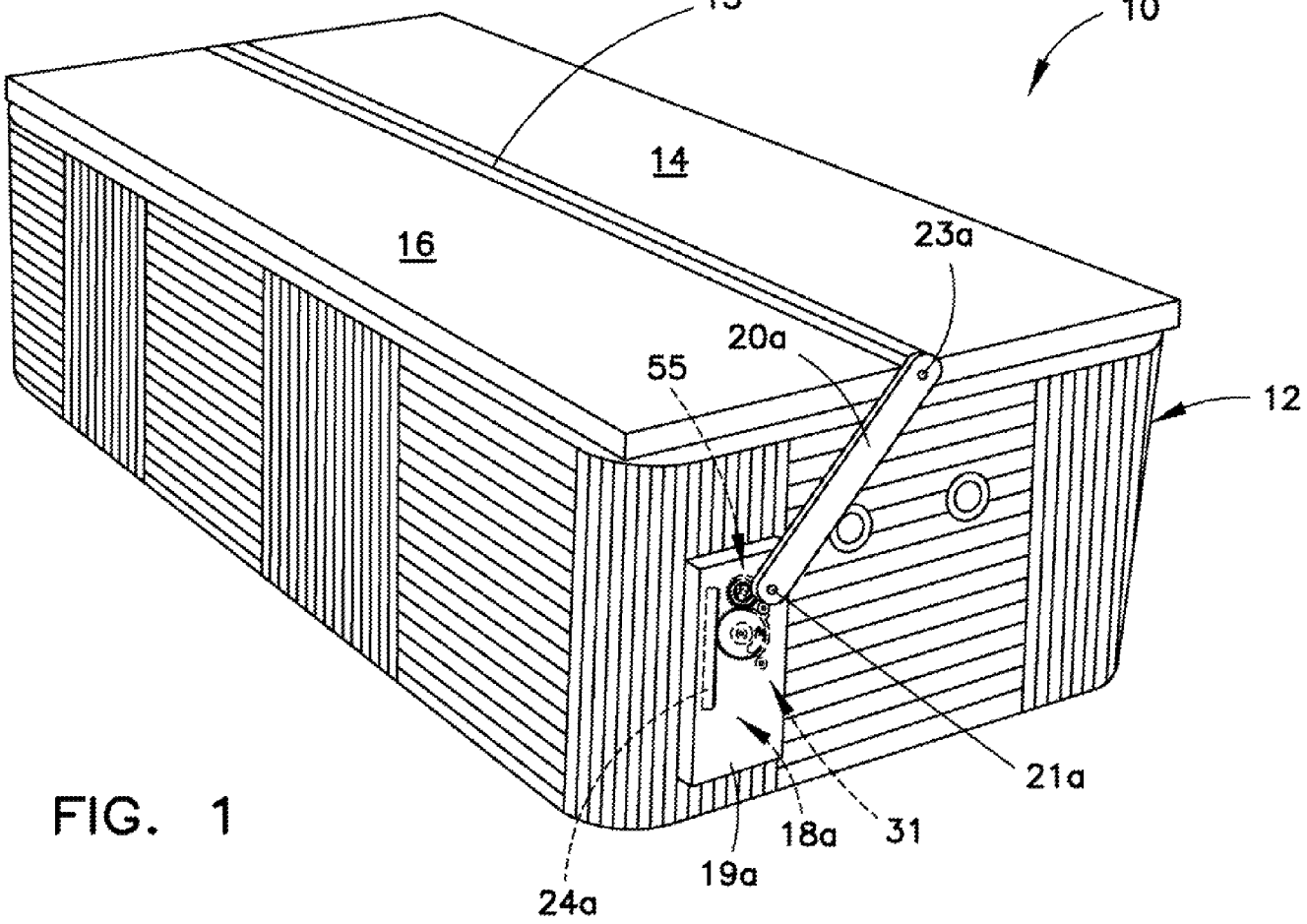
FIG. 1 is a perspective view of a swim spa as seen from one end thereof, the swim spa having a system for automatically opening and closing a longitudinal two-part hinged swim spa cover, the swim spa cover shown in a closed position.
Figure 2:
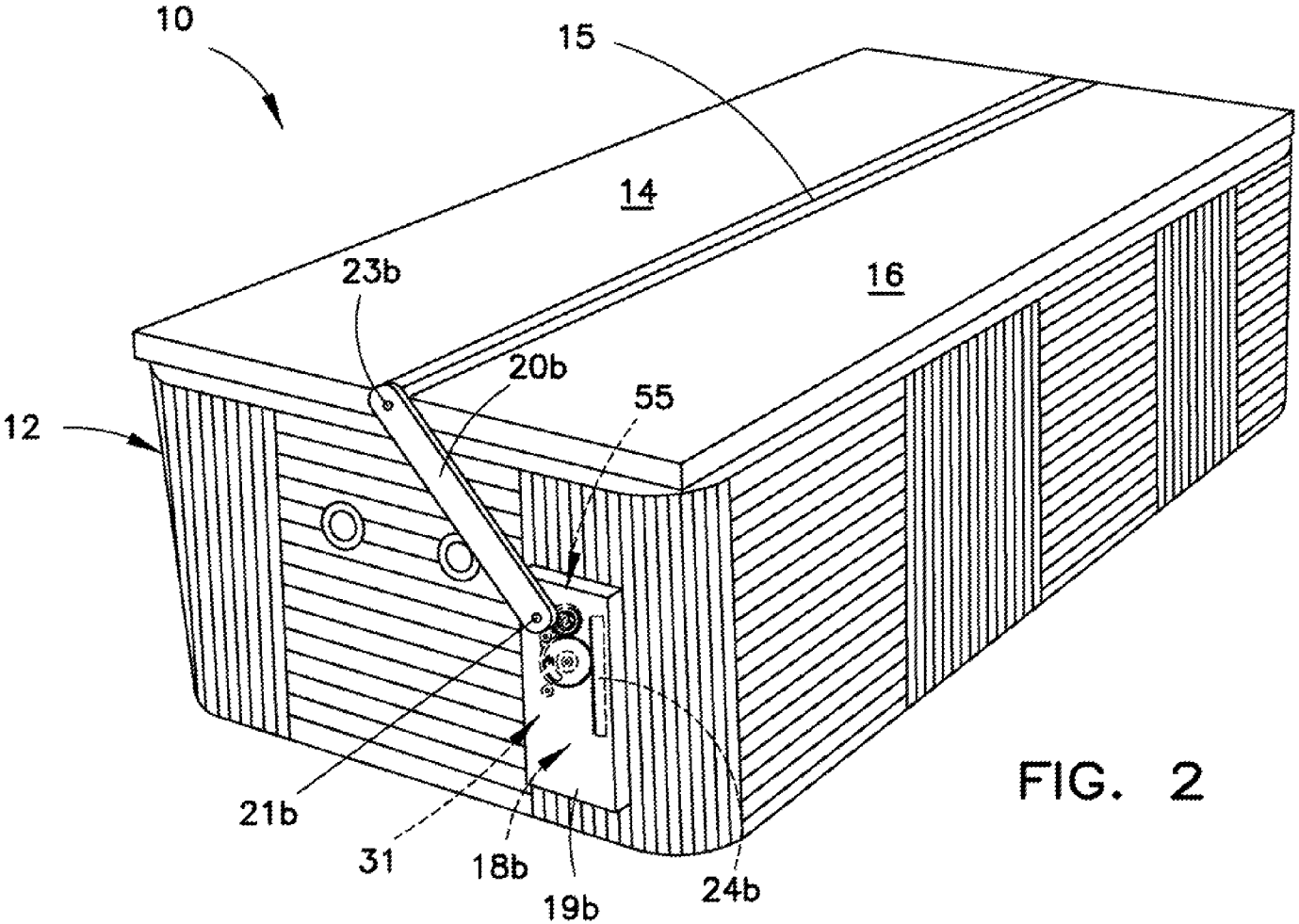
FIG. 2 is a perspective view of an opposite end of the swim spa of FIG. 1 having the system for automatically opening and closing the longitudinal two-part hinged swim spa cover, the swim spa cover shown in a closed position.
Figure 3:
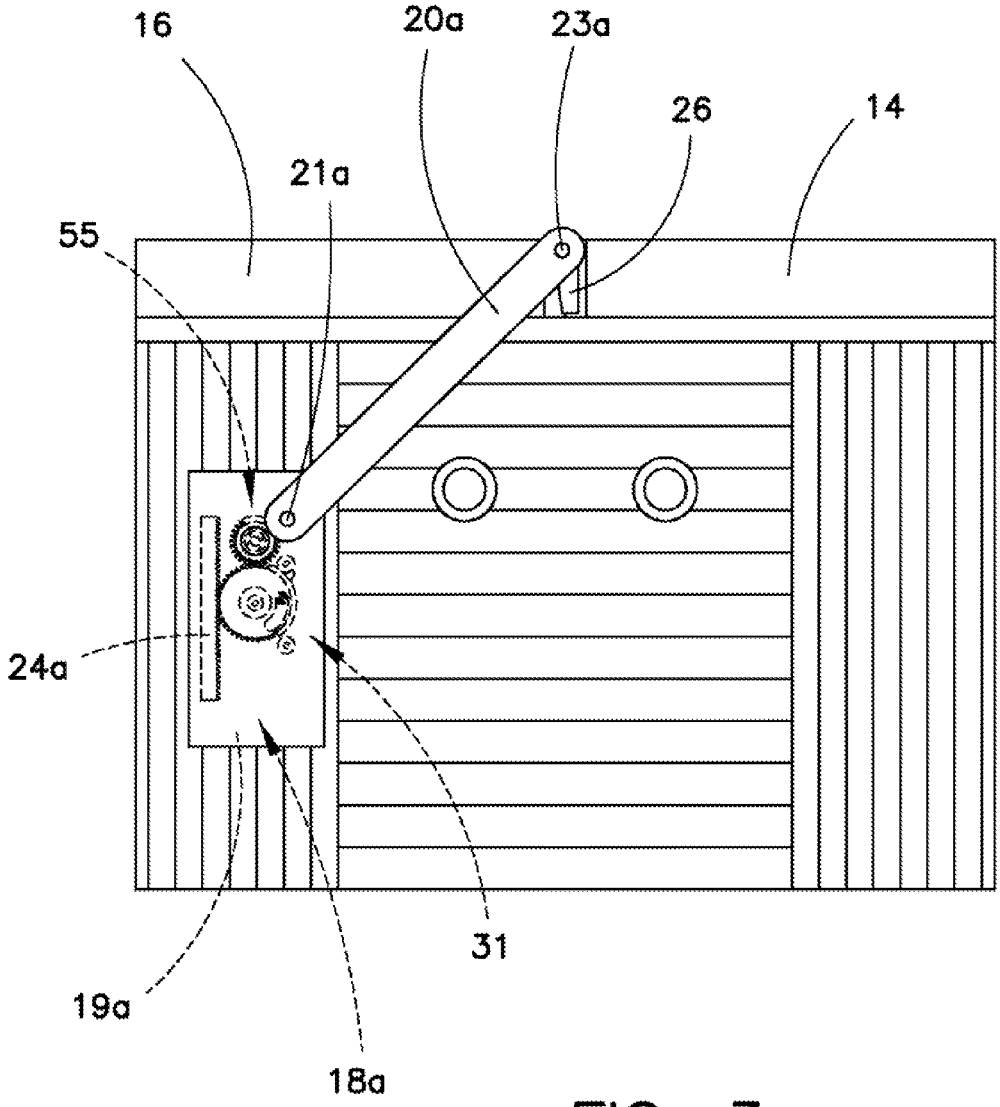
FIG. 3 is an end view of the swim spa of FIGS. 1 and 2 with the swim spa cover in a closed position.

Referring to FIGS. 1-3 there is depicted several views of an exemplary swim spa, generally designated 12, having an automatic swim spa cover opening and closing system 10 fashioned in accordance with the present principles. FIG. 1 is a perspective of a first longitudinal end of the swim spa 12, FIG. 2 is a perspective view of a second longitudinal end of the swim spa 12, and FIG. 3 is a plan view of the first longitudinal end of the swim spa 12. The swim spa 12 is shown with a longitudinally-oriented swim spa cover formed by first and second longitudinal cover parts 14, 16 that are pivotally connected to one another along longitudinal ends thereof via a flexible hinge 15. The first and second parts preferably, but not necessarily, comprise pads, cushions, mats or the like the type of which is known in the art. The first and second cover parts 14, 16 (the cover) are shown in a closed position in FIGS. 1-3 lying on the swim spa and over the interior.

Referring to FIGS. 1 and 3, the automatic swim spa cover opening and closing system 10 includes a first drive mechanism 18*a* mounted on or otherwise associated with the first longitudinal end or side of the swim spa 12. In this embodiment, the first drive mechanism 18*a* is mounted to the first longitudinal end of the swim spa and sealed behind and within a first cover 19*a*—i.e. a "built-in" version. The first drive mechanism 18*a* may alternatively be mounted on a plate or other structure within a sealed enclosure that is adapted to be attached to or otherwise associated with the first longitudinal end as a retro-fit component for an existing swim spa that does not have the present automatic swim spa cover opening and closing system 10.

The first drive mechanism 18*a*, as depicted by dashed lines in FIGS. 1 and 3 since the drive mechanism 18*a* is sealed within and behind the cover 19*a*, includes a first drive cylinder 24*a*, main drive gearing 31, and arm drive gearing 55. A first drive arm 20*a* is operatively connected at one end thereof to the arm drive gearing 55 (see, e.g., FIGS. 5-8) through an axle/pivot 21*a* that is fixed to the swim spa 12 such that the first drive arm 20*a* pivots relative to the swim spa 12. A second end of the first drive arm 20*a* is operatively connected to gearing (see, e.g. FIG. 8 and below) through axle/pivot 23*a* and to a first end of a longitudinal cover support 30.

Referring to FIG. 2, the automatic swim spa cover opening and closing system 10 includes a second drive mechanism 18*b* mounted on or otherwise associated with the second longitudinal end or side of the swim spa 12. In this embodiment and in like manner to the first drive mechanism 18*a*, the second drive mechanism 18*b* is mounted to the other longitudinal end of the swim spa and sealed within and behind a second cover 19*b* (the "built-in" version). In the retro-fit version, the second drive mechanism 18*b* would be mounted on a plate or other structure within a sealed enclosure that is adapted to be attached to or otherwise associated with the second longitudinal end.

The second drive mechanism 18*b*, as depicted by dashed lines in FIG. 2 since the drive mechanism 18*b* is sealed within and behind the cover 19*b*, includes a second drive cylinder 24*b*, main drive gearing 31, and arm drive gearing 55 that are identical in form and function to the cylinder and gearing (both the main gearing and the arm gearing) of the first drive mechanism 18*a*. A second drive arm 20*b* is operatively connect at one end thereof to the arm drive gearing 55 identical to gearing for the first drive mechanism 18*a* through an axle/pivot 21*b* that is fixed to the swim spa 12 such that the second drive arm 20*b* pivots relative to the swim spa 12. A second end of the second drive arm 20*b* is operatively connected to gearing identical to gearing for the first drive arm 20*a* through axle/pivot 23*b* and to a second end of the longitudinal support 30.

When removing the hinged, longitudinal two-part cover 14, 16 from the swim spa 12 (i.e. opening the cover or swim spa), the first and second drive mechanism 18*a*, 18*b* each separately, but in tandem, control and drive their respective drive arm (i.e. first drive arm 20*a* with respect to the first drive mechanism 18*a*, and second drive arm 20*b* with respect to the second drive mechanism 18*b*). As depicted in the sequence of illustrations of FIGS. 11A-C, in a cover opening operation, the present automatic swim spa cover opening and closing system 10 initially begins to lift the first cover part 14 from the swim spa 12 along its longitudinal axis and pivot the first cover part 14 along its longitudinal hinge 15 (FIG. 11A), flips the first cover part 14 onto the second cover part 16 (FIG. 11B), then flips the stacked first and second cover parts 14, 16 over the side of the swim spa 12 (FIG. 11C). When performing a closing operation, (i.e. putting the two-part cover 14, 16 back onto and over the swim spa 12, the process is reversed. The opening and closing operation is driven by the drive mechanisms 18*a*, 18*b* as described below.

Figure 4:
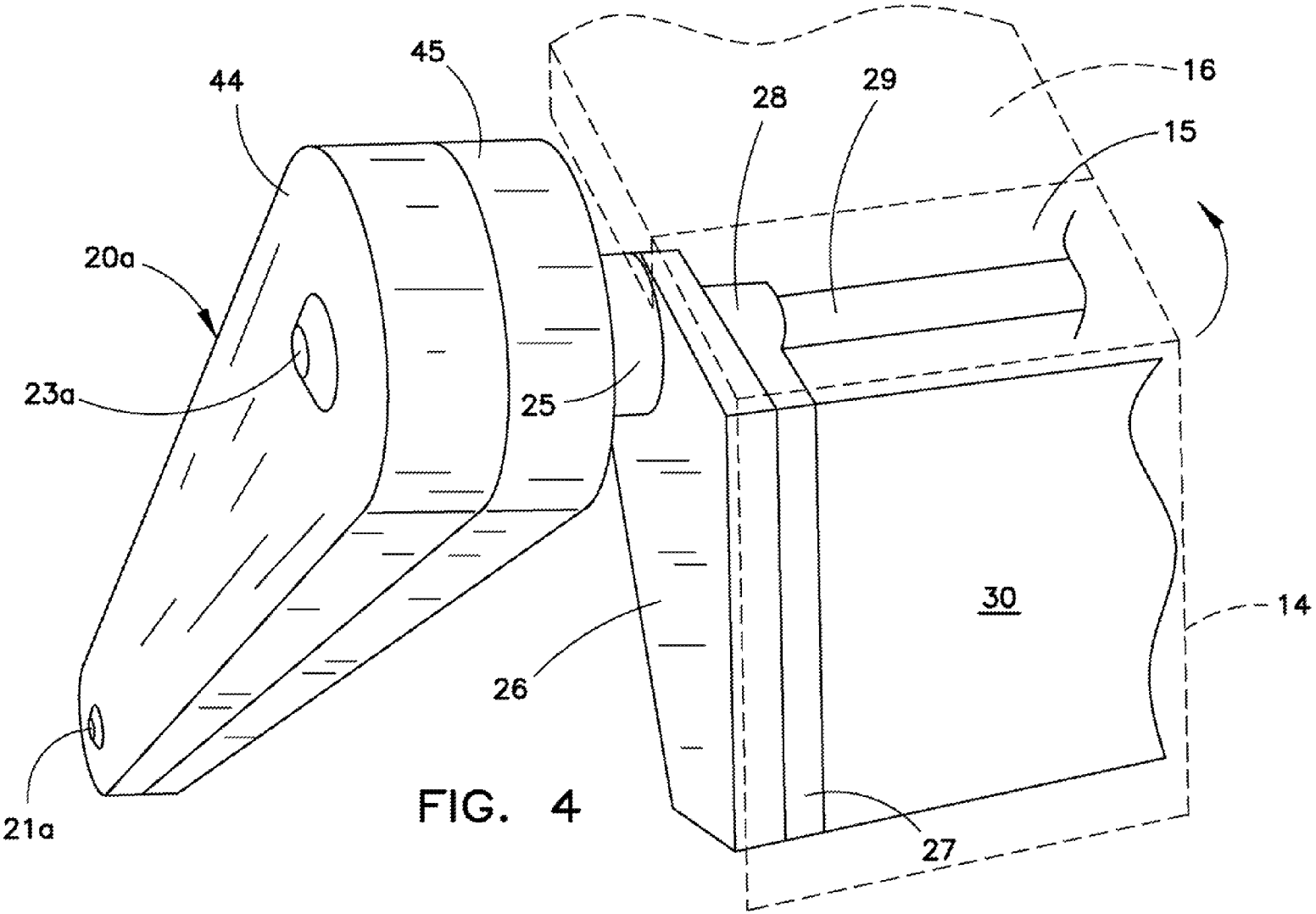
FIG. 4 is an enlarged view of the connection of a drive arm of one side of the present system as attached to a longitudinal support that extends between the ends of the two cover parts of the two-part hinged swim spa cover and under the hinge connecting the two cover parts.

Referring to FIG. 4, there is depicted a close up of a manner of connection of the first drive arm 20*a* of the present automatic swim spa cover opening and closing system 10 to a longitudinal pivot rod 29 of the present system 10 and to the first end of the longitudinal support 30. The first drive arm 20*a*, formed by first and second housing parts 44, 45, is connected to the axle/pivot 23*a* through a hub 25 via a face plate 26. The face plate 26 is connected to an end plate 27 having a hub 28 that connects to the longitudinal pivot rod 29. The longitudinal pivot rod 29 may be a single rod that extends longitudinally along the longitudinal sides of the two cover parts 14, 16, in which case the second drive arm 20*b* connects to the other end of the longitudinal pivot rod 29 in like manner to the first drive arm 20*a*, or may be two separate pivot rods each extending a length from the respective drive arm along the longitudinal sides of the two cover parts 14, 16. In both cases, the pivot rod 29 is disposed under the flexible hinge 15 connecting the two cover parts 14, 16.

The plates 26, 27 are connected to the first longitudinal end of the longitudinal support 30. While not shown, like plates and other portions connect the second drive arm 20*b* to the second longitudinal end of the longitudinal support 30. In the embodiment shown, the longitudinal support 30 is a single support that extends the entire longitudinal length of the cover parts 14, 16. In an alternate embodiment, the longitudinal support 30 is formed by two longitudinal support components, one longitudinal support component extending from the first longitudinal end of the swim spa, and the other longitudinal support component extending from the second longitudinal end of the swim spa. Other manners of connection to the longitudinal support or supports may be used and are envisioned.

It should be appreciated that the features, components, characteristics and operation of the first drive mechanism 18*a*, first drive arm 20*a* and all associated components are applicable to the second drive mechanism 18*b*, the second drive arm 20*b* and all associated components unless otherwise indicated. Therefore, in the following description, only one drive mechanism (i.e. the first drive mechanism 18*a*), drive arm (i.e. first drive arm 20*a*) and all associated components as well as the operation of the present automatic swim spa cover opening and closing system 10 will be described.

Figure 5:
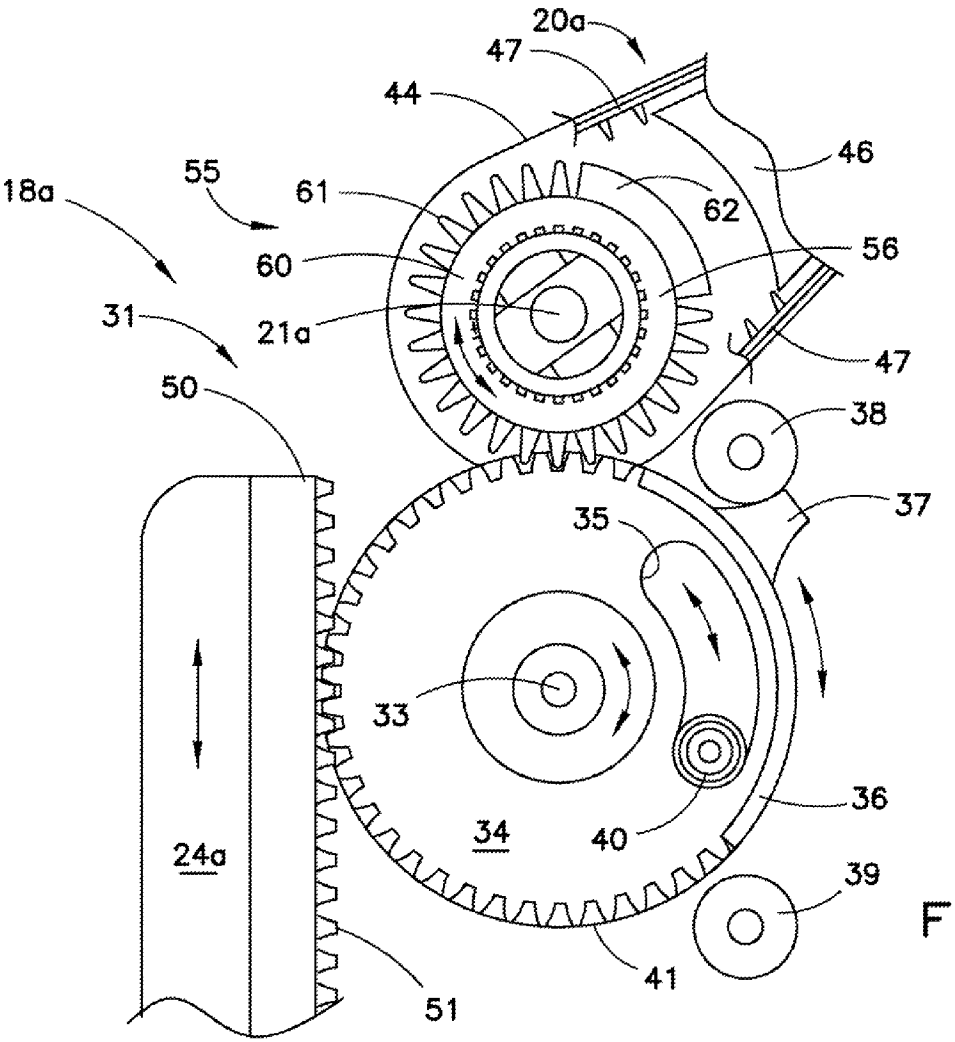
FIG. 5 is an enlarged front side view of major components of one drive mechanism of the present system particularly showing the gearing of the drive mechanism as it connects to gearing of the drive arm thereof.
Figure 6:
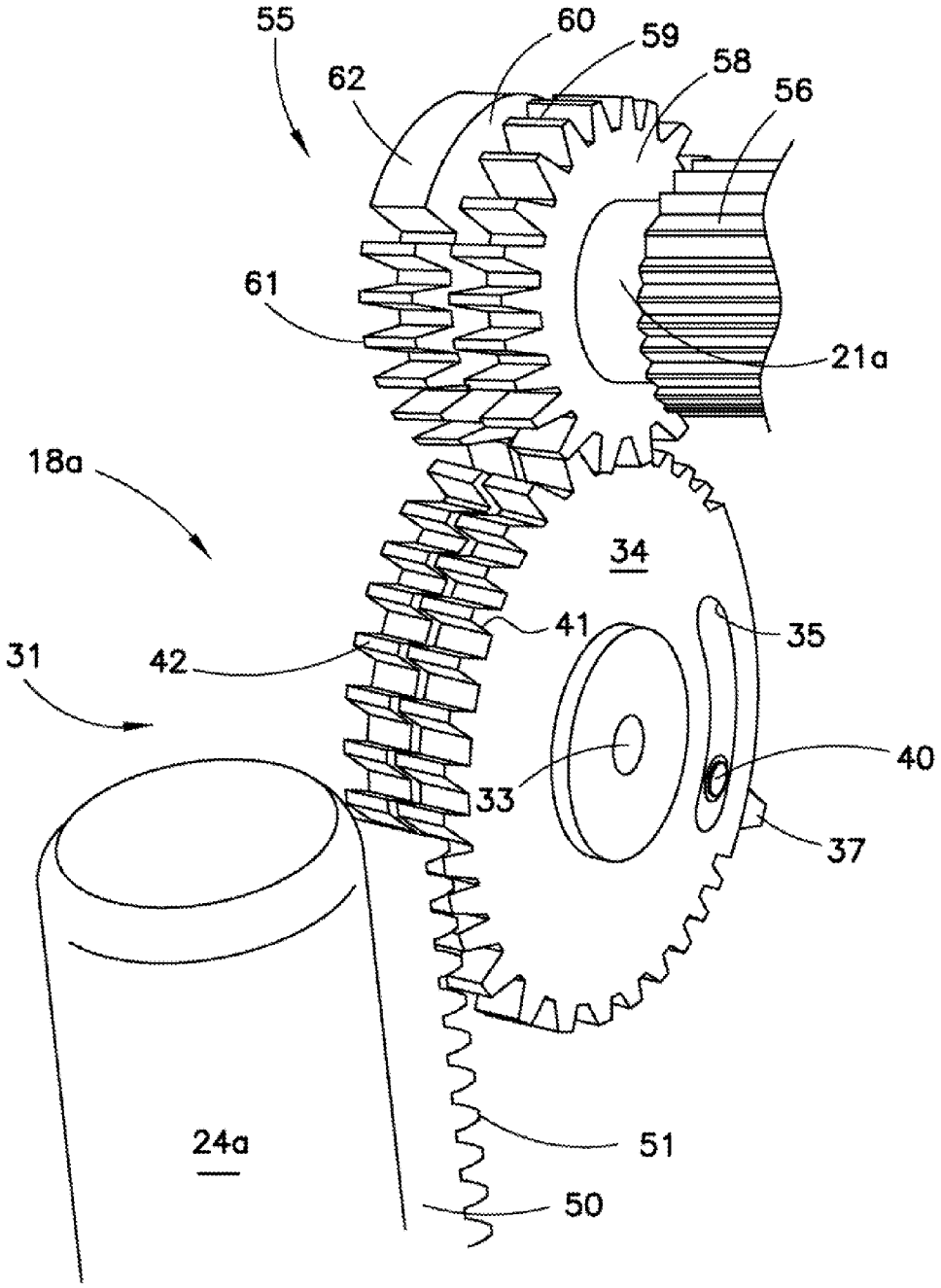
FIG. 6 is an enlarged rear perspective view of the major components of the one drive mechanism of the present system particularly showing the gearing of the drive mechanism as it connects to gearing of the drive arm thereof.
Figure 7:
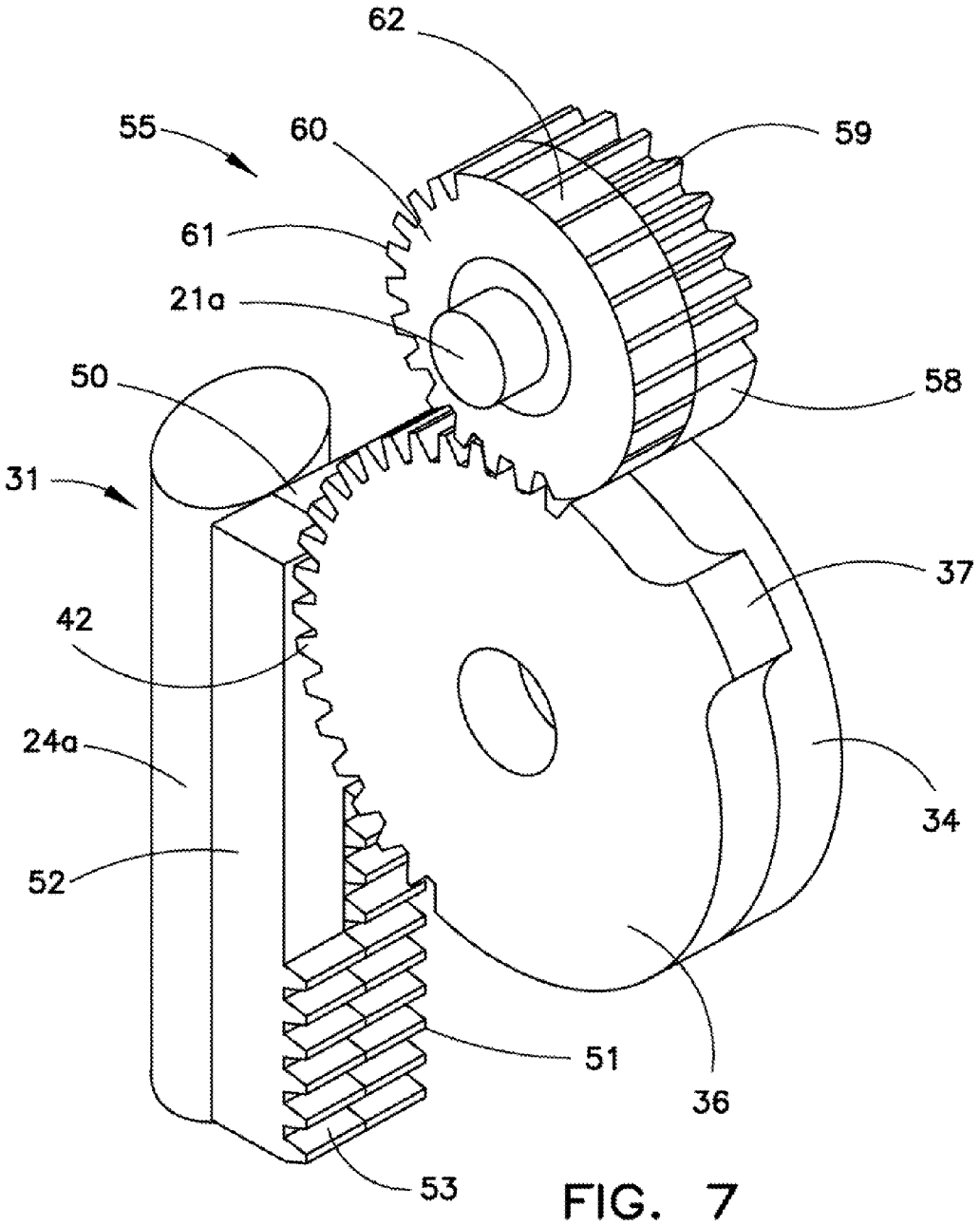
FIG. 7 is a front perspective view of the components of the one drive mechanism of the present system particularly showing the gearing of the drive mechanism as it connects to gearing of the drive arm thereof.

Referring to FIGS. 5-7 there is depicted various view of the first drive mechanism 18*a*. The first drive mechanism 18*a* includes a drive cylinder 24*a* that operates drive gearing 31 that, in turn, operates arm drive gearing 55. The cylinder 24*a* is preferably, but not necessarily, a hydraulic cylinder. However, cylinders using other actuation methods may be used. Connected to the drive cylinder 24*a* is a first ratchet 50 having a first set of teeth 51 that extend along the length of the ratchet 50, and a second ratchet 52 having a second set of teeth 53 that extend a portion of the length of the ratchet 52. The ratchets 50, 52 move up and down as the cylinder 24*a* is appropriately actuated and/or un-actuated. The teeth 51 of the ratchet 50 interact with the teeth 41 of gear 34 while the teeth 53 of the ratchet 52 interact with the teeth 42 of gear 36. Particularly, as the ratchet 50 moves up and down through manipulation of the cylinder 24*a*, the ratchet 50 rotates the gear 34 in opposite directions. As the ratchet 52 moves up and down through manipulation of the cylinder 24*a*, ratchet 52 selectively rotates the gear 36 in opposite directions.

Figure 10C:
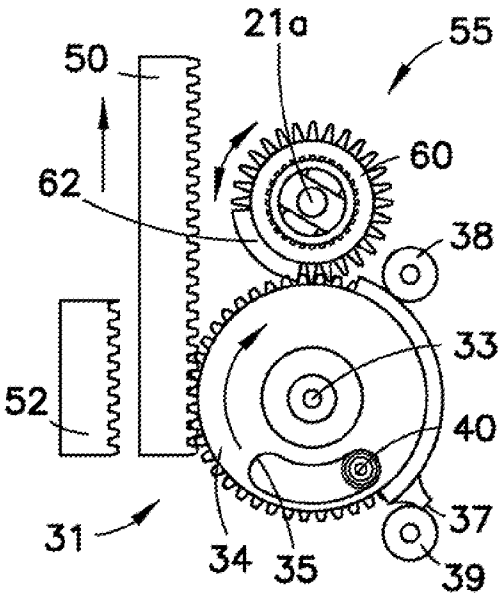
FIGS. 10A-C depict a side schematic view of the sequence of a drive mechanism of the present system relative to and as ratchets of the drive cylinder move drive mechanism gearing to open the longitudinal two-part hinged cover.
Figure 10B:
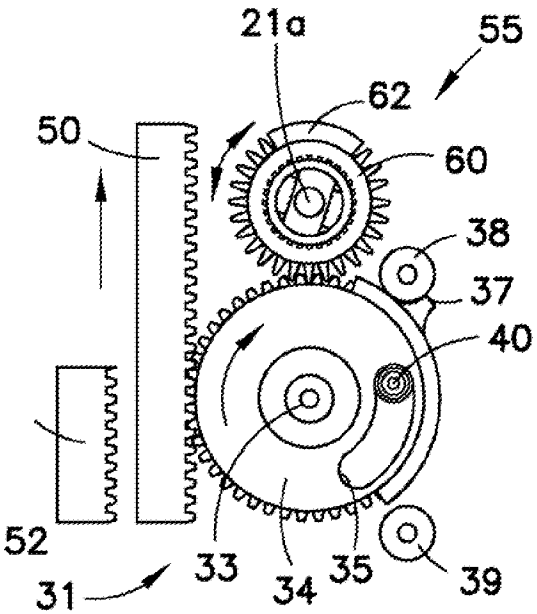
Figure 10A:
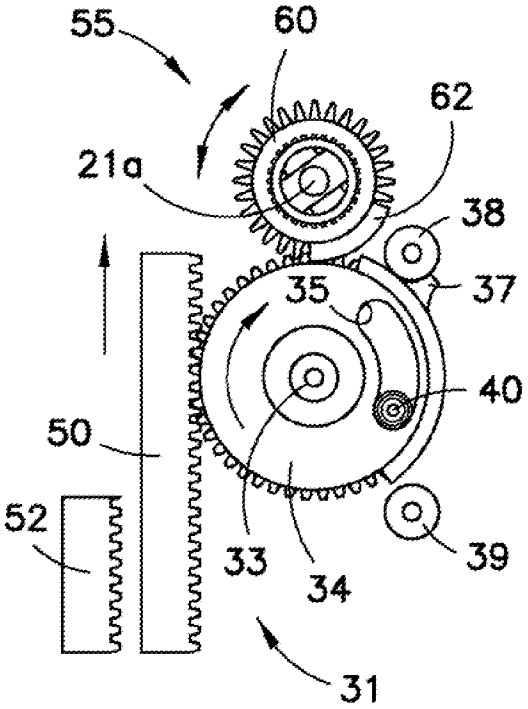

As shown, the drive gearing 31 is coupled to the drive arm gearing 55 such that rotation of the gears 34, 36 cause rotation of gears 58 and 60 and thus axle/pivot 21*a* and housing connection sprocket 56. Particularly, as the ratchet 50 moves up, gear 34 is rotated which rotates gear 58 of the drive arm gearing 55, which in turn drives the belt 47, rotating the arm sprocket 49, pivoting the longitudinal support 30, thereby opening (pivoting) the cover part 14. At the same time, as the ratchet 52 moves up it eventually meshes with and rotates the gear 36, which in turn rotates gear 60 of the drive arm gearing 55 to pivot the drive arm 20*a* from a closed position (as seen, e.g., in FIGS. 1 and 2) to an open position (as seen, e.g. in FIG. 11C). FIGS. 10A-C illustrate this process. As the cylinder 32 moves the ratchets 50, 52 down, the reverse operation ensues.

Because the drive arms 20*a*, 20*b* must support at least the weight of the two cover portions 14, 16 when pivoting between the cover open position and the cover closed position, extra support and/or travel guards are provided in the drive gearing 31 and the drive arm gearing 55. Particularly, with respect to the drive gearing 31, the gear 34 includes an arcuate slot 35 that receives a post 40 of the gear 36. A radially extending flange 37 is provided off the periphery of the gear 36. As the gear 34 rotates, the arcuate slot 35 rotates until it engages the post 40. At this time, the two gears 34, 36 rotate in tandem. The flange 37 rotates between the external posts 38 and 39 providing stops for gear rotation. The gear 60 of the drive arm gearing 55 includes an arcuate peripheral stop 62 that also aids in pivoting the drive arm 20*a*.

Figure 9:
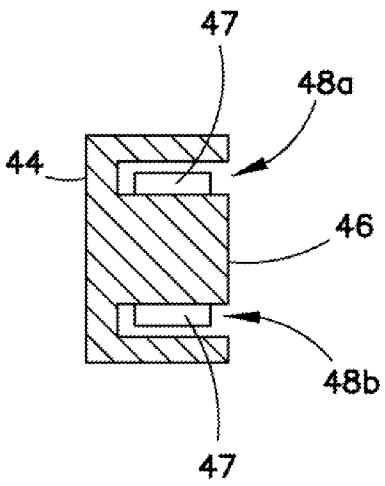
FIG. 9 is a sectional view of the one drive arm as seen in FIG. 8 taken along line 9-9 thereof.
Figure 8:
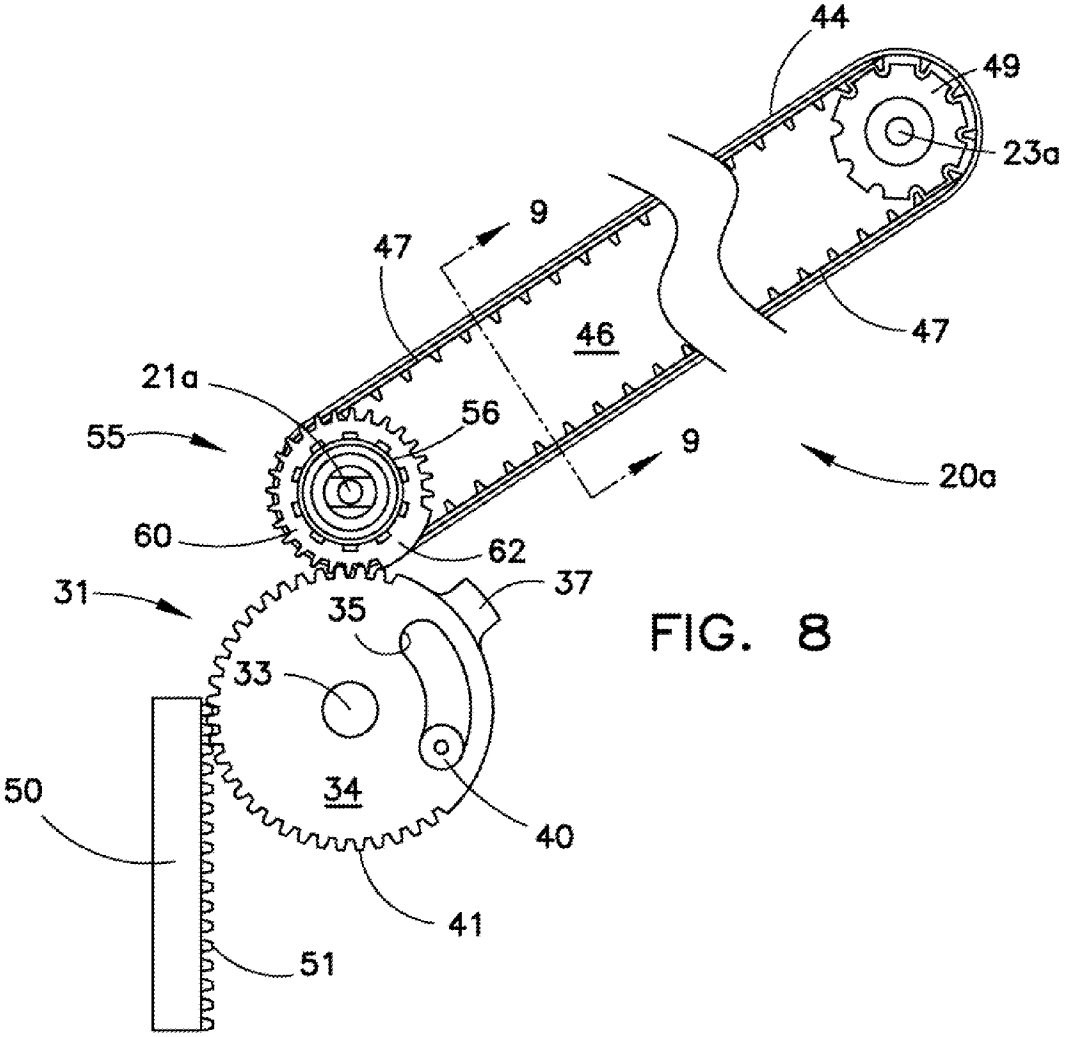
FIG. 8 is a side view of the connection between the drive mechanism and the internal components of the one drive arm, with a housing part of the one housing part removed, as it connects to the longitudinal cover support of the present system.

FIG. 8 shows the first drive arm 20*a* in a longitudinal sectional view wherein one housing part 45 has been removed, while FIG. 9 is a sectional view of the drive arm taken along line 9-9 thereof. In FIG. 8, the first drive arm 20*a* is shown relative to the drive gearing 31. The housing part 45 holds the arm drive gearing 55 at one end of the first drive arm 8*a* (i.e. the axle/pivot 21*a*) that is operatively connected to and which operates a drive belt 47. The housing part 45 includes a land 46 that defines a first channel 48*a* on one side thereof, and a second channel 48*b* on a second side thereof. The drive belt 47 is contained in the channels 48*a*, 48*b*. The first drive arm 20*a* also includes a sprocket 49 on the other end thereof and situated about axle/pivot 23*a*. The drive belt 47 is held by the sprocket 49 such that as the drive belt 47 is rotated by the drive gearing 55, the sprocket 49 rotates.

Rotation of the sprocket 49 in one direction pivots or rotates the plates 26, 27 connected thereto and thus the longitudinal support 30 in one direction, while rotation of the sprocket 49 in the other direction pivots or rotates the plates 26, 27 connected thereto and thus the longitudinal support 30 in the other direction. One direction opens the first cover part 14 (flips it onto the second cover part 16), while one direction closes the first cover part 14 (flips it from on top of the second cover part 14 to over the swim spa 12). As controlled by the first drive mechanism 18*a*, rotation of the drive belt 47 and thus the sprocket 49 ceases when the first cover part 14 is on the second cover part 16. The first drive mechanism 18*a* also causes the first drive arm 20*a* to rotate/pivot about the axle/pivot 21*a* to remove the stacked first and second cover parts from the swim spa in one direction, and to place the stowed first and second cover parts onto the swim spa. This occurs when the drive belt 47 is idle.

FIGS. 10A-C show the sequence of movement of the gearing 31 and 55, particularly gears 34 and 36 and gear 60 as the cover 14, 16 is being opened. The sequence of the movement of the gears 34, 36 and 60 for closing the cover is the reverse thereof, i.e. FIGS. 10C-A and the reverse of the following description of the cover opening. Reference is also directed to FIG. 8 since the gearing 55 is within and associated with the arm 20*a*. It should be appreciated that the racks 50 and 52 of FIGS. 10A-C are shown separately and without the corresponding drive cylinder for illustrative purposes. As shown in the other figures, the racks 50 and 52 are disposed on or associated with the drive cylinder and next to each other.

FIG. 10A depicts the initial stage wherein the drive cylinder begins to upwardly move the racks 50, 52. The rack 50, being in meshed contact with the teeth of the gear 34, begins to rotate the gear 34. As the gear 34 rotates it rotates the gear 58 of the drive arm gearing which rotates or drives the belt 47. The belt 47 in turn rotates the sprocket 49 which pivots the longitudinal support 30. FIG. 11A depicts this action and pivoting of the cover portion 14. At this point, the flange 37 of the gear 36 is positioned adjacent the stop 38 while the post 40 of the gear 36 is at a bottom most position within the arcuate slot 35 of the gear 34. While the rack 52 also upwardly moves, its lower position is such that its teeth do not yet come into contact with the teeth 61 of the gear 60.

FIG. 10B depicts an intermediate stage wherein the drive cylinder continues to upwardly move the racks 50, 52. The rack 50 continues to rotate the gear 34 which, as described above, pivots the longitudinal support 30 to pivot the cover portion 14 onto the cover portion 16 (see FIG. 11B). When the gear 34 is rotated into the position shown in FIG. 10B, the arcuate slot 35 has rotated relative to the post 40 such that the post 40 is now at an end of the arcuate slot 35. At this point, the rack 52 begins to come into contact with the teeth 42 of the gear 60. Because the cover portion 14 has now been pivoted onto the cover portion 16, it is time to pivot both cover portions 14, 16 off of the swim spa 12.

FIG. 100C depicts the final position wherein the rack 50 has fully rotated the gear 34, the rack 52 has reached, meshed with and fully rotated the gear 36 which in turn has rotated the gear 60. The continued rotation of the gear 34 assists in the rotation of the gear 36 through the end of the arcuate slot 35 pulling the post 40 there along as the gear 36 also rotates. At the same time, the flange 37 moves from the stop 38 to the stop 39. The stop 39 prevents over-rotation of the gears. At this point, pivoting of the longitudinal support 30 has stopped and the arm 20*a* itself pivots to pivot the cover portions 14, 16 from the swim spa 12 (see FIG. 11C).

As illustrated in the figures and described above, the present automatic swim spa cover opening and closing system 10 is robust enough to open and close a longitudinally hinged, two-part longitudinal cover for a swim spa, something which has not been previously successful.

While the invention has been illustrated and described in detail in the drawings and foregoing description, the same is to be considered as illustrative and not restrictive in character and that all changes and modifications that come within the spirit of the invention are desired to be protected.

What is claimed is:

1. A system for use with a spa having first and second longitudinal ends and defining an opening, the system comprising:

a first cover element that extends across the opening between the first and second longitudinal ends of the spa;

a second cover element pivotally coupled to the first cover element by a hinge, wherein the second cover element extends across the opening between the first and second longitudinal ends of the spa and wherein the first cover element can rotate about the hinge relative to the second cover element;

a first drive assembly situated on the first longitudinal end of the spa wherein the first drive assembly includes a first actuating cylinder operatively carrying first and second ratchets, and first drive gearing driven by the first and second ratchets;

a second drive assembly situated on the second longitudinal end of the spa, wherein the second drive assembly includes a second actuating cylinder operatively carrying third and fourth ratchets, and second drive gearing driven by the third and fourth ratchets;

a first arm assembly operatively connected at a first end to the first drive assembly;

a second arm assembly operatively connected at a first end to the second drive assembly;

a longitudinal support for the cover having a first end operatively connected to a second end of the first arm assembly, and a second end operatively connected to a second end of the second arm assembly, the longitudinal support situated between the two cover parts and below the hinge when the cover is closed;

wherein the longitudinal support is operatively connected to the first and second drive assemblies by the first and second arm assemblies such that the first and second drive assemblies, operating separately, but in tandem, rotate the longitudinal support relative to the first and second arm assemblies for stacking and un-stacking the first cover element relative to the second cover element during respective opening and closing of the spa, wherein the first and second drive assemblies independently pivot the first and second arm assemblies relative to the spa to move the stacked first and second cover elements between a stowed position and a position where the second cover element covers a portion of the opening, wherein the first arm assembly includes arm gearing operatively coupled to the first drive gearing, and a first drive sprocket operatively connected to the longitudinal support and wherein the second arm assembly includes arm gearing operatively coupled to the second drive gearing, and a second drive sprocket operatively connected to the longitudinal support.

2. The system of claim 1, wherein:

the first drive sprocket is operatively connected to the first drive gearing via a first drive belt; and the second drive sprocket is operatively connected to the second drive gearing via a second drive belt.

3. The system of claim 2, wherein:

the first drive gearing comprises first and second drive gears with the first drive gear driven by the first ratchet and the second drive gear driven by the second ratchet; and the second drive gearing comprises third and fourth drive gears with the third drive gear driven by the third ratchet and the fourth drive gear driven by the fourth ratchet.

4. The system of claim 3, wherein:

the first arm gearing comprises first and second arm gears with the first arm gear driven by the first drive gear and the second arm gear driven by the second drive gear; and the second arm gearing comprises third and fourth arm gears with the third arm gear driven by the third drive gear and the fourth arm gear driven by the fourth drive gear.

5. The system of claim 1, wherein the spa cover is a swim spa cover having a longitudinal length of at least 12 feet.

6. The system of claim 1, wherein the first and second actuating cylinders are hydraulic cylinders.

7. The system of claim 1, wherein the first actuating cylinder moves the first and second ratchets in unison, wherein the first drive gearing includes a first and second gear, wherein the first ratchet includes teeth that are always engaged with the first gear, wherein the second ratchet includes a toothed portion having teeth engageable with the second gear and a non-toothed portion that can move relative to the second gear without engaging the second gear, wherein the first gear is operatively connected to the longitudinal support to rotate the longitudinal support relative to the first arm assembly and wherein the second gear is operatively connected to the first arm assembly to pivot the first arm assembly relative to the spa.

8. The system of claim 7, further comprising a post that extends from the second gear through a slot defined in the first gear, wherein the post and slot permit the first gear to rotate relative to the second gear when the second gear is not engaged with the toothed portion of the second ratchet and wherein the slot is configured such that the post abuts the first gear and causes the first and second gears to rotate together when the second gear is engaged with the toothed portion of the second ratchet.

9. The system of claim 1, wherein the first cover element future comprises a side surface facing the second cover element and the longitudinal support covers the side surface.

10. The system of claim 1, wherein the first cover element is operatively coupled to the longitudinal support such that rotation of the longitudinal support rotates the first cover element relative to the second cover element.

11. An apparatus comprising:

a spa having first and second longitudinal ends and defining an opening;

a first cover element that extend across the opening;

a second cover element pivotally coupled to the first cover element by a hinge, wherein the second cover element extends across the opening and wherein the first cover element is rotatable about the hinge relative to the second cover element;

a first arm assembly pivotally coupled to the spa at one end of the spa;

a second arm assembly pivotally coupled to the spa at an opposite end of the spa;

a longitudinal support extending between the first and second arm assemblies, wherein the longitudinal support is situated between the first and second cover elements and is positioned at least partially below the hinge and wherein the first cover element is operatively coupled to the longitudinal support such that rotation of the longitudinal support rotates the first cover element relative to the second cover element;

a first drive assembly;

a first gear assembly operatively coupling the first drive assembly to the longitudinal support through the first arm assembly such that actuation of the first drive assembly rotates the longitudinal support relative to the first arm assembly thereby rotating the first cover element about the hinge relative to the second cover element; and a second gear assembly operatively coupling the first drive assembly to the first arm assembly such that actuation of the first drive assembly rotates the first arm assembly relative to the spa thereby moving the first and second cover elements between a closed position where the second cover element extends across the opening and a stowed position where the second cover element does not extend across the opening, wherein the first drive assembly comprises a first actuating cylinder that moves first and second ratchets; a first gear and a second gear, wherein the first ratchet includes teeth that are always engaged with the first gear, wherein the second ratchet includes a toothed portion having teeth that can engage the second gear and a non-toothed portion that can move relative to the second gear without engaging the second gear, wherein the first gear is operatively connected to the longitudinal support to rotate the longitudinal support relative to the first arm assembly and wherein the second gear is operatively connected to the first arm assembly to pivot the first arm assembly relative to the spa.

12. The apparatus of claim 11, further comprising:

a second drive assembly;

a third gear assembly operatively coupling the second drive assembly to the longitudinal support through the second arm assembly such that actuation of the second drive assembly rotates the longitudinal support relative to the second arm assembly thereby rotating the first cover element about the hinge relative to the second cover element; and a fourth gear assembly operatively coupling the second drive assembly to the second arm assembly such that actuation of the second drive assembly rotates the second arm assembly relative to the spa thereby moving the first and second cover elements between a closed position where the second cover element extends across the opening and a stowed position where the second cover element does not extend across the opening, wherein the first and second drive assemblies operate separately, but in tandem.

13. The apparatus of claim 11, further comprising a drive belt that is operatively connected between the first gear and the longitudinal support.

14. The apparatus of claim 11, further comprising a post that extends from the second gear through a slot defined in the first gear, wherein the post and slot permit the first gear to rotate relative to the second gear when the second gear is not engaged with the toothed portion of the second ratchet and wherein the slot is configured such that the post abuts the first gear and causes the first and second gears to rotate together when the second gear is engaged with the toothed portion of the second ratchet.

15. The apparatus of claim 11, wherein the first actuating cylinder is a hydraulic cylinder.

16. The apparatus of claim 11, wherein the first cover element future comprises a side surface facing the second cover element and the longitudinal support covers the side surface.

17. The apparatus of claim 11, wherein the opening, the first cover element, the second cover element and the longitudinal support each have a longitudinal length of at least 12 feet.

* * * * *